United States Patent [19]

Pistorius

[11] Patent Number: 4,572,420

[45] Date of Patent: Feb. 25, 1986

[54] HAND LEVER OPERATED VEE NAIL FRAME ASSEMBLY MACHINE

[76] Inventor: Albert Pistorius, 22 Ingold Dr., Dix Hills, N.Y. 11746

[21] Appl. No.: 684,071

[22] Filed: Dec. 20, 1984

[51] Int. Cl.[4] ..... B25C 5/02; B25C 7/00

[52] U.S. Cl. ..... 227/110; 227/113; 227/152; 227/154

[58] Field of Search ..... 227/110, 113, 152, 154, 227/30, 140, 148; 269/41

[56] References Cited

U.S. PATENT DOCUMENTS

| | | | |
|---|---|---|---|
| 199,579 | 1/1878 | Rose | 227/148 |
| 978,187 | 12/1910 | Miller | 227/148 X |
| 2,183,789 | 12/1939 | DeRusha et al. | 227/152 |
| 2,900,638 | 8/1959 | O'Kelley | 227/154 |
| 2,903,699 | 9/1959 | Mazzola | 227/152 |
| 3,112,105 | 11/1963 | Keller | 227/152 |
| 4,127,226 | 11/1978 | Jasper | 227/148 X |
| 4,258,873 | 3/1981 | Vela | 269/41 X |
| 4,436,234 | 3/1984 | Kennedy | 227/30 X |

*Primary Examiner*—Paul A. Bell
*Assistant Examiner*—Taylor J. Ross
*Attorney, Agent, or Firm*—Leonard Belkin

[57] ABSTRACT

A vee nail frame assembly machine which is manually operated. The machine has a guide arrangement for supporting the frame members to be joined and a movable assembly which carries the operative parts for embedding the nail. The assembly carries a post having magnets embedded therein to support the vee nail. When the movable assembly is retracted a vee nail is placed on the post. The assembly is then moved into place where the post is aligned with the frame members. A hand lever is provided which actuates the nail post to move up and contact the frame members and then embed the nail.

12 Claims, 11 Drawing Figures

HAND LEVER OPERATED VEE NAIL FRAME ASSEMBLY MACHINE

BACKGROUND OF THE INVENTION

This invention relates to a vee nail frame assembly machine and more particularly to a hand lever operated frame assembly machine for the blind joining of the mitered corners of picture frames and the like.

A variety of devices are available for assembling and stapling mitered joint frame members. Typical of such apparatus is shown in U.S. Pat. Nos. 199,579 to Rose, 2,903,699 to Mazzola, and 4,258,873 to Vela where provision is included to mount the frame members to be joined and drive in the nails or staples which are to clamp the parts together.

As will be noted from the aforementioned patents, devices of this type tend to be complicated, heavy and expensive to manufacture. In addition, substantial operator training and skill are usually required to use such equipment and in many cases, as in the patent to Mazzola, a power source is needed.

Because of the complexity, size and expense of frame assembly machines now available, it is not unusual for shops which prepare or order custom picture frames and the like to assemble and join each frame completely manually. That is, the frame members are placed in a suitable vise and the parts are nailed together using a hammer, staple gun, screws, etc.

SUMMARY OF THE INVENTION

In the present invention, the problems mentioned above are overcome or substantially reduced by providing a lightweight, machine of simple design and construction which is hand lever operated capable of producing professional quality joints in a frame with vee nails leaving no exposed holes or slots.

In accordance with a preferred embodiment of this invention, the above is accomplished by providing a vise arrangement for supporting a pair of frame members in planar relationship with their adjacent mitered ends abutting each other mounted on a platform. A device mounted on the platform clamps the frame members down. An assembly with an upwardly extending post extends up through the platform with the post terminating just below the frame members where they are to be joined. The post has embedded therein magnets for supporting magnetically a vee nail. The assembly has a hand lever operated mechanism extending below the platform so that when the lever is rotated the post is driven upwardly. The post is provided with a sleeve so that when the post makes contact with the frame members the sleeve drives the vee nail into the frame members straddling the mitered ends and thus joining the two members together.

The preferred embodiment of the invention as described above incorporates a base to permit the apparatus to be mounted conveniently on the end of a work bench. The post assembly is slidable on the platform to permit convenient replenishments of the vee nail, and other features as hereinafter described make it possible to set accurately the location of the vee nails, permit other types of fastening methods to be employed, and to accomplish other advantages of this invention.

It is thus a principal object of this invention to provide a hand lever operated frame assembly of simple design and construction which is easy to operate.

Other objects and advantages of this invention will hereinafter become obvious from the following description of a preferred embodiment of this invention.

DETAILED DESCRIPTION OF THE PREFERRED EMBODIMENT

The purpose of this invention, as already noted, is to produce a unique machine for joining mitered frame members. This is illustrated in FIGS. 1–5 where it is seen that frame members 2 and 4 are joined at their mitered ends by a vee nail 6. The latter is made from a thin piece of suitable ferrous metal for a reason to be later described, bent at right angles with a pair of wings 6*a* and 6*b*. One edge is beveled to produce a cutting edge 6*c* where nail 6 enters frame members 2 and 4. As will be noted from FIGS. 4 and 5, more than one nail 6 may be employed, and for thicker frame members, one nail may be stacked behind the other.

Figure 6:
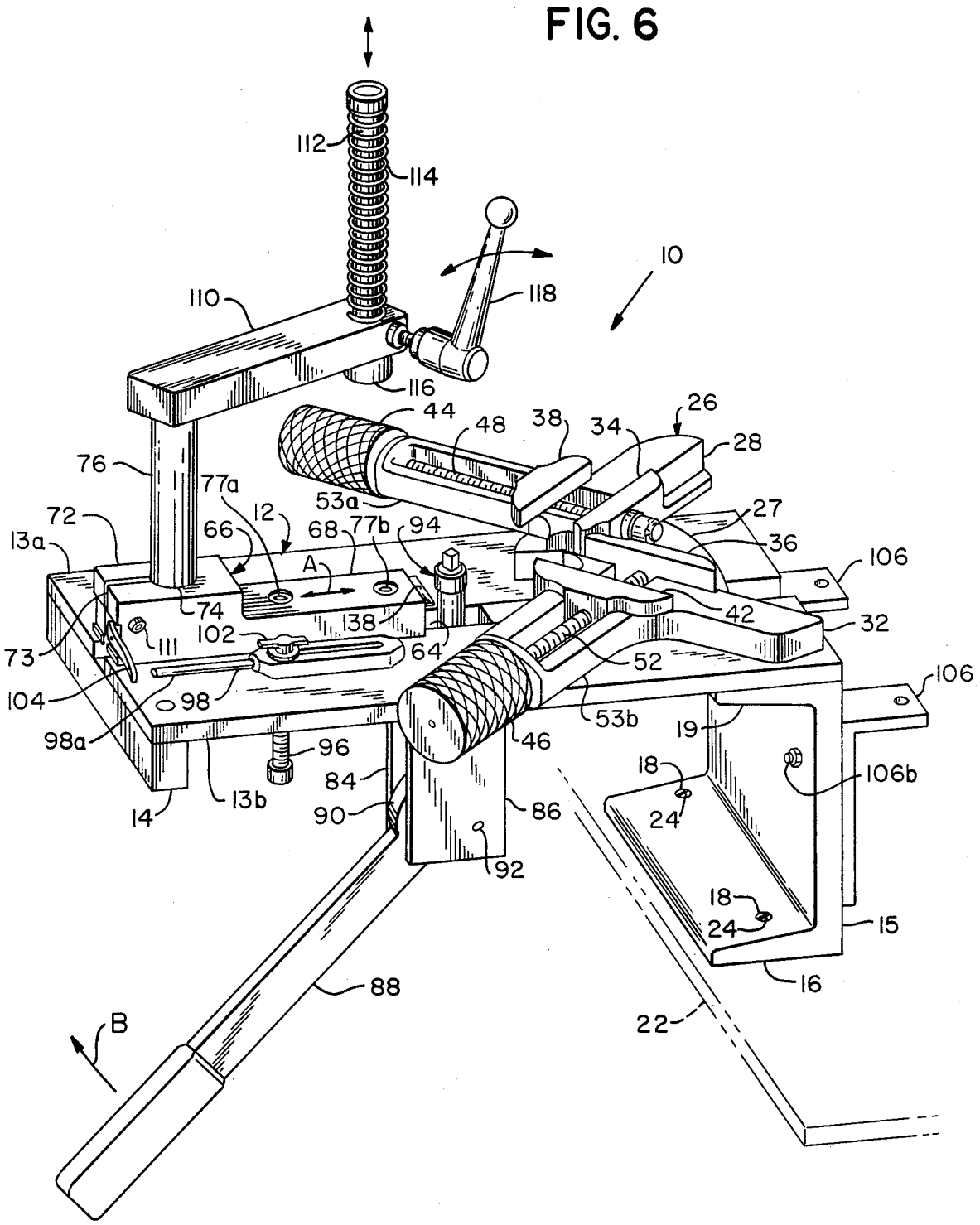
FIG. 6 is an isometric view of a preferred embodiment of this invention.
Figure 7:
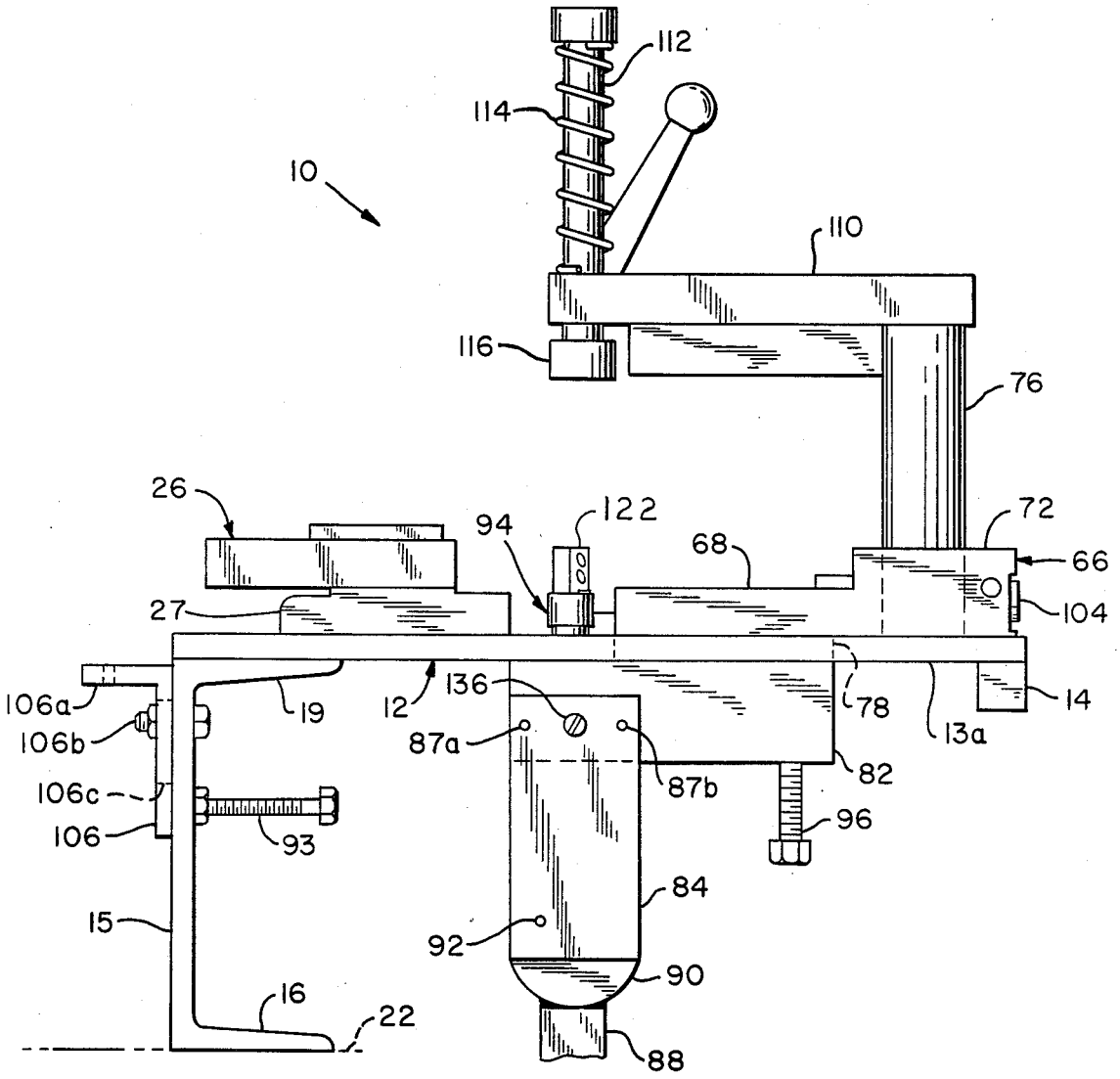
FIG. 7 is a rear side elevation view of the machine shown in FIG. 6 with some details of the guide arrangement removed.

For a detailed description of the machine designed to produce such a joint and which is the preferred embodiment of this invention for driving nails 6 into frame members 2 and 4, reference is made to FIGS. 6 and 7 wherein it is seen that machine 10 consists of a platform 12 formed by a pair of spaced plates 13*a* and 13*b* supported at one end by a bar 14 and at the other end by a channel bar 15 having a base mount 16 having a pair of holes 18, and a leg 19 to support the other end of spaced plates 13*a* and 13*b*. Typically machine 10 would be mounted for support on the end of a work bench 22 with countersunk screws 24 passing through holes 18 and threaded into bench 22. It is understood that other mounting arrangements may be employed such as using a single screw or bolt to permit the machine to be pivoted.

Figure 8:
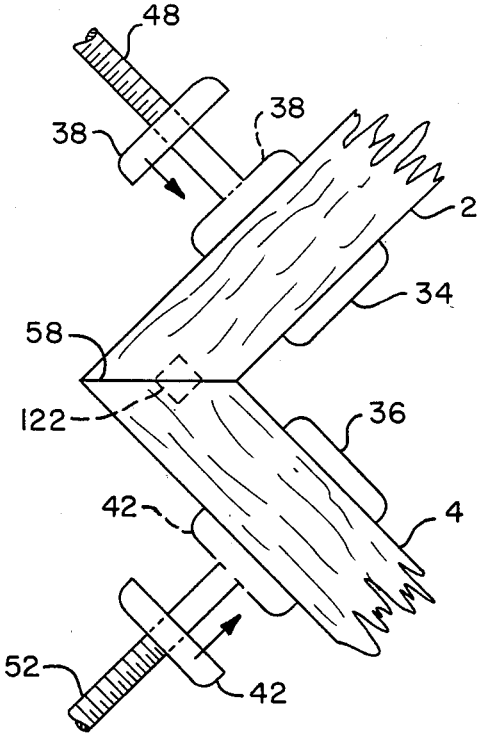
FIG. 8 is a partial plan and functional view of the guide arrangement for holding the frame members and the relationship with the nail post.

Supported on platform 12 is a vise arrangement consisting of a stationary frame support assembly 26 which consists of a base 27 mounted on platform 12 integral with a pair of horizontally extending legs 28 and 32 at right angles to each other and a stationary jaw 34 and 36 on each leg, respectively. In addition, there is provided a pair of movable clamping jaws 38 and 42 adjusted by a pair of speed handles 44 and 46 connected to movable guides 38 and 42 through screw members 48 and 52, respectively, passing through open housings 53*a* and 53*b* extending from legs 28 and 32, respectively. Screw members 48 and 52 are threaded through threaded openings in guides 38 and 42, respectively. By rotating speed handles 44 and 46 and screws 48 and 52 rigidly attached thereto, respectively, the spacing between stationary and movable jaws 34, 36 and 38, 42, respectively, is adjusted to clamp in planar quadrature relationship the adjacent frame members 2 and 4 being joined as seen in FIG. 8. Other than right angle joints can be accomplished by using a support assembly with jaws oriented for the angle desired. Frame members 2 and 4 are to be joined at 58 by one or more nails 6 previously described. Nals 6 are driven up through the underside (unfinished side) of frame members 2 and 4 as will be described below.

Platform 12 is provided with an elongated slot 64 formed between plates 13*a* and 13*b*. A slide assembly 66 for movement along slot 64 consists of a plate 68 straddling slot 64 for movement indicated by double headed arrow A, having a pedestal 72 split at 73 and provided with an opening 74 for supporting clamp post 76. Assembly 66 also includes a member 78 inside of slot 64 attached by bolts 77*a* and 77*b* to the underside of plate 68 and joined with a member 82 (see FIG. 7) which supports a pair of downwardly extending, spaced plates 84 and 86 utilizing a pair of bolts 87*a* and 87*b* to support drive handle 88. The latter terminates in a cam 90 pivoted on a shaft 92 so that when handle 88 is rotated in the direction of arrow B cam 90 drives upwardly a column assembly 94 whose details and function will be described below. From member 82 extends downwardly a stop member 96 to limit the travel of drive handle 88. A rear stop 93 limits the travel of slide assembly 66.

As seen in FIG. 6, on top of platform 12 is a piggyback stop assembly 98 controlled by a finger operated nut 102 for selectively limiting the movement of assembly 66 to the right, in effect lining up column assembly 94 to the point under the frame members 2 and 4 to be joined. A tongue 104 attached by any convenient means to and extending from pedestal 72 makes contact with stop assembly 98 thereby halting the travel of assembly 68 and column assembly 94. Stop assembly 98 is slotted with an extended member 98*a*.

A pair of L-shaped members 106 vertically slidable and mounted as shown on channel bar 15 make it possible to attach a table on top of the legs 106*a* of members 106 and attached by a bolt 106*b* to support, if needed, any oversized frame members. Members 106 have slots 106*c* to accommodate bolts 106*b* to permit the vertical adjustment.

Extending up from pedestal 72, as already has been noted, is a clamp post 76 which supports one end of an arm 110 which on its other end has mounted a back-up rod 112 biased upwardly by a spring 114 with a locking handle 118 as illustrated. A bolt 111 permits post 74 to be locked in place. When frames 2 and 4 are mounted and clamped as shown in FIG. 8, and assembly 66 is moved to the right until column assembly 94 is lined up under the abutting frame members 2 and 4 for nailing, post 112 is pushed down until pad 116, mounted on the bottom of rod 112 contacts frames 2 and 4 at their joint, and locking handle 118 is rotated clockwise to lock post 112 in place, thus insuring that frame members 2 and 4 remain stationary as vee nail 6 is inserted from underneath. Locking handle 118 may be provided with a mechanism to position it for most comfortable use by the operator. As seen in FIG. 8, nail post 122 is aligned with joint 58 at a point where vee nail 6 is to be inserted. By loosening bolt 111, clamp post 76 with arm 110 can be readily removed should some other fastening method such as the use of a hammer, screws, staples or glue be employed.

In the illustrated arrangement, the rotation of handle counterclockwise releases rod 112 which will retract under the influence of spring 114. If desired, spring 114 may be removed in which case, rod 112 would be locked in its retracted position. When handle 118 is turned to release rod 112, then the latter will drop down to contact frame members 2 and 4.

Figure 9:
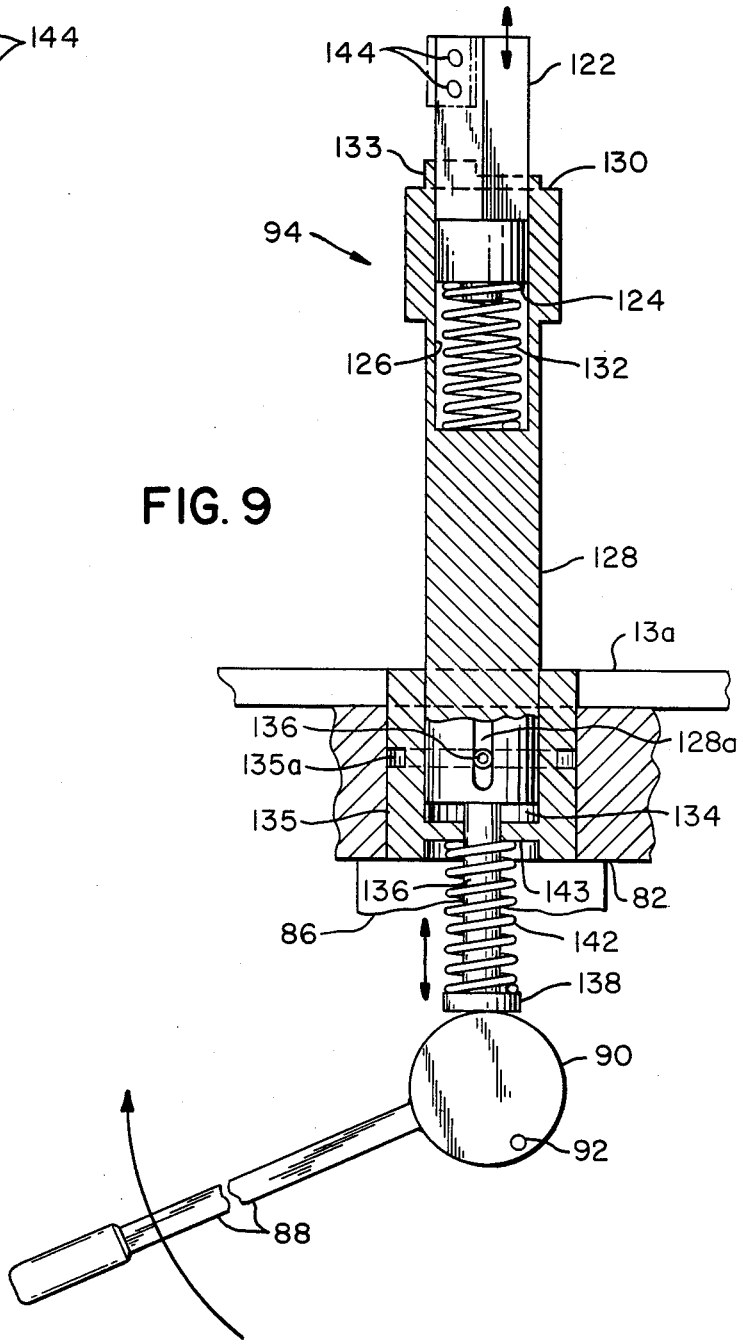
FIG. 9 is an elevation view in section of the nail post assembly.

For details of column assembly 94 which supports nail post 112, reference is made to FIG. 9. The purpose of assembly 94 is to mount nail 6 in such way that when drive handle 88 is rotated in the direction shown by its arrow, nail 6 will be driven up into frames 2 and 4.

Assembly 94 consists of a square nail post 122 connected at its bottom to a cylindrical member 124 inserted in a circular cavity 126 in a circular shaft 128. A spring 132 joining the bottom of member 124 to the bottom of cavity 126 biases post 122 upwardly as shown. The top of shaft 128 is provided with an enlarged rim 130 for reinforcement and an extension 133 which will be described below. The bottom of shaft 128 fits into an opening 134 in a sleeve 135 located within member 82 (which is part of and moves with slide assembly 66 previously described) and has a rod 136 which extends down through member 82 and terminates in a stopper 138 which rides on the outer surface of cam 90. A spring 142 between a shoulder 143 and stopper 138 biases the latter into contact with cam 90. Sleeve 135 has a slot 135*a* to accommodate a set screw 136 which when loosened permits post 172 to be rotated. Once set at the proper angular position, set screw 136 is tightened within groove 128*a* in shaft 128.

Figure 10:
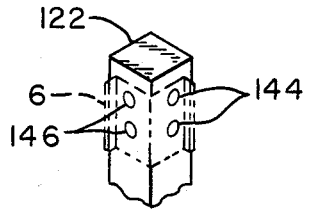
FIG. 10 is an isometric view of the nail post showing the disposition of a vee nail.

Nail post 122 is provided with two pairs of magnets 144 and 146 embedded into adjacent surfaces of post 122 on the same side as drive handle 88. As seen in FIG. 10, vee nail 6, which is made of magnetizable material such as an iron alloy, is placed on post 122. A ruler 138 placed on platform 12 along side slide assembly 66 may be employed for rough locations in repetitive nailing situations.

Figure 11:
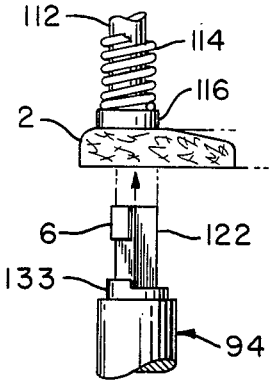
FIG. 11 is a detail and functional diagram of a frame member in relation to the nail post and the backup rod.

When handle 88 is rotated in the direction shown by its arrow in FIG. 9, shaft 128 is driven upwardly until post 122 makes contact with the underside of frames 2 and 4, as illustrated in FIG. 11. After this contact is made, shaft 128 continues to move upwardly compressing spring 132, and extension 133 contacts vee nail 6 and drives it upwardly into frames 2 and 4 thereby joining them at their mitered ends. FIG. 11 shows also how back-up rod 112 holds frame members 2 and 4 in place. It will be noted also that extension 133 has an upper abutting surface to contact vee nail 6 and drive it up.

In the operation of machine 10, the latter is mounted on work bench 22 for convenience of use as shown in FIG. 6. With handle 88 down and slide assembly 66 pulled to the right as shown in FIG. 7 (or to the left as shown in FIG. 6), the top of post 122 is just below the top surfaces of stationary frame support assembly 26 on which the frame members are to be placed. Frame members 2 and 4 with mitered ends are placed on assembly 26 as seen in FIG. 8 and speed handles 44 and 46 are rotated so as to clamp them between movable jaws 38 and 42, and stationery jaws 34 and 36, respectively.

Figure 1:
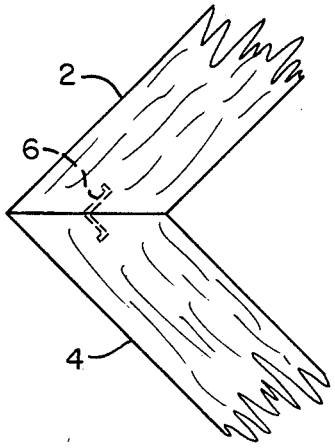
FIG. 1 is a plan view of a pair of frame members with mitered ends joined by a vee nail.
Figure 2:
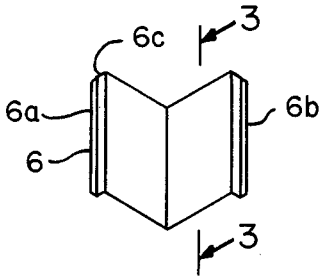
FIG. 2 is an isometric view of a vee nail.
Figure 3:
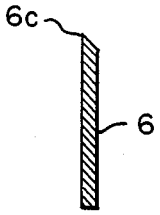
FIG. 3 is a view along 3—3 taken from FIG. 2.
Figure 4:
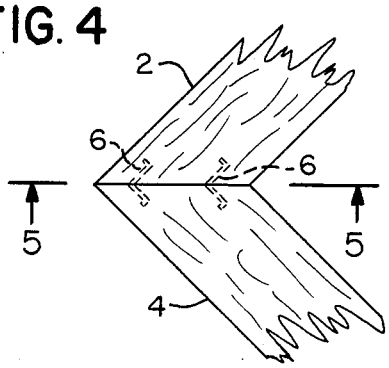
FIG. 4 is a plan view of a pair of frame members with mitered ends joined by two vee nails.
Figure 5:
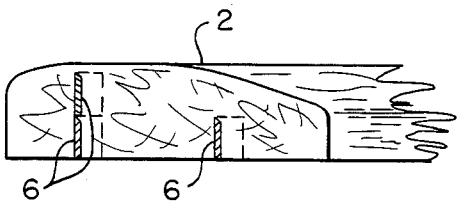
FIG. 5 is a view along 5—5 in FIG. 4.

A vee nail 6 with knife edge up 48 is placed by the operator on post 122 as illustrated in FIG. 10, and slide assembly is pushed to the right (see FIG. 6) until post 122 is lined up where nail 6 is to be inserted (as seen in FIG. 11). For repeated use, and especially where it is desired to push a second nail up behind a first nail as where the frame members are particularly thick as seen in FIG. 5, piggyback stop 98 is adjusted and locked so that tongue 104 will stop slide assembly 66 so that it will come to rest at exactly the same place each time it is moved into place for nailing. Rod 112 is pushed down until contact is made with the frame members and clamping handle 118 is rotated to lock rod 112 in place. The length of arm 110 is such that pad 116 coincides with nail 6.

Then drive handle 88 is pulled by the operator toward him, driving nail 6 up into the frame members to be joined. Handle 88 is then dropped down retracting post 122 and assembly 66 is withdrawn so that another nail 6 can be mounted. If a second nail is to be inserted in the same joint but at a different location, tongue 104 which may be pivotally mounted by a screw on the back of pedestal 72 can be raised and avoid piggy-back stop 98 if assembly 66 is to be moved further in. If the second nail is to be placed under the first nail pushing the latter up, then stop 98 insures that there will be accurate alignment of the two nails.

One of the advantages of this invention is that the operator is located on the side where nailing takes place opposite to that of the frame. This means that no matter how large the frame is, the operator is close to where the nailing takes place and never has to stand inside the frame as in many existing nailing machines.

From the preceding description of the preferred embodiment of this invention it is seen that there has been provided a vee nail frame assembly machine of unique design and construction operable without the need for an external power source such as compressed air or electricity and yet at the same time is effective, efficient and capable of being operated by one person with a minimum of manual labor.

The machine is capable of making joints of professional quality, permitting accurate, repetitive positioning of the frame members without the need for tools or extensive set-up time.

Due to the relative simplicity of its design, the machine has a minimum of working parts and is capable of trouble free operation. It should be noted that the size of the nails employed can be changed as long as they can be placed on the nail post.

While only a preferred embodiment of this invention has been described it is understood that many variations in the construction are possible without departing from the principles and scope of this invention as defined in the claims which follow.

What is claimed is:

1. Apparatus for joining together the mitered ends of a pair of frame members comprising:

a. means for supporting said frame members in planar relationship with their adjacent mitered ends abutting each other;

b. platform means to carry said supporting means;

c. assembly means movable between first and second positions comprising post means extending up through said platform means terminating beneath said frame members when said assembly means is in its first position, said post means comprising a post and actuating means extending below said platform means for actuating said post upwardly, said post having means to support magnetically a vee nail of magnetizable material, said post when said assembly is in its second position being accessible for mounting thereon a vee nail;

d. said actuating means including a lever operated handle means which upon rotation drives said post upwardly, and further including means in response to said post coming into contact with said frame members for driving said vee nail into said frame members thereby joining the latter together; and e. said assembly means further comprising means for selectively clamping down on said frame members while said nail is driven into said frame members.

2. The apparatus of claim 1 in which said supporting means comprises a stationery guide for each of said frame members and an adjustable guide for each of said frame members, and means for adjusting the position of each of said adjustable guides so as to lock each of said frame members against a stationery guide.

3. The apparatus of claim 1 having selectively adjustable stop means for setting in advance the first position of said assembly means so that when the latter is moved from its second position to its first position said post will be accurately positioned beneath said frame members.

4. The apparatus of claim 1 in which said post includes a pair of adjacent surfaces to correspond to the bend in said vee nail, and the vee nail support means in said post consists of at least one magnet embedded in in each of the aforesaid adjacent surfaces.

5. The appartus of claim 1 in which said platform means includes an elongated slot therethrough, said assembly means extending through said slot and movable along the length of said slot, said supporting means for said frame members being located on said platform means straddling said slot with the abutting ends of said frame members being above said slot thereby accessible to said post.

6. The apparatus of claim 5 in which said post means extends up through said slot and movable along with said assembly means along the length of said slot.

7. The apparatus of claim 1 in which said actuating means comprises an elongated handle having a cam mounted on one end thereof, said post means having means biased in contact with said cam for driving said post upwardly when said handle means is rotated in the direction of actuating said post means.

8. The apparatus of claim 1 having means to support a table adjacent said supporting means for accommodating said frame members.

9. The apparatus of claim 1 having stop means to limit movement of said handle means when rotated in the direction of actuating said post means.

10. The apparatus of claim 1 having means to support said apparatus along the edge of a work bench or other surface and leaving said handle means accessible for movement and handling by an operator.

11. The apparatus of claim 1 in which said clamping means is removable to permit the application of other methods for fastening said frame members.

12. The apparatus of claim 4 in which the adjacent surfaces of said post for mounting of said vee nail faces the direction where said handle means is accessible to said operator thereby rendering said apparatus convenient for use by a single operator.

* * * * *